United States Patent [19]

Cosyns et al.

[11] Patent Number: 5,059,732

[45] Date of Patent: Oct. 22, 1991

[54] PROCESS FOR SELECTIVE CATALYTIC HYDROGENATION IN LIQUID PHASE OF A NORMALLY GASEOUS FEED CONTAINING ETHYLENE, ACETYLENE AND GASOLINE

[75] Inventors: Jean Cosyns, Maule; Jean-Paul Boitiaux, Poissy, both of France

[73] Assignee: Institut Francais du Petrol, Rueil Malmaison, France

[21] Appl. No.: 689,095

[22] Filed: Apr. 22, 1991

Related U.S. Application Data

[63] Continuation of Ser. No. 327,444, Mar. 22, 1989, abandoned.

[30] Foreign Application Priority Data

Mar. 23, 1988 [FR] France ..... 88 03909

[51] Int. Cl.[5] ..... C07C 5/00; C07C 7/00

[52] U.S. Cl. ..... 585/259; 208/143; 208/144

[58] Field of Search ..... 208/143, 144; 585/259

[56] References Cited

U.S. PATENT DOCUMENTS

| | | | |
|---|---|---|---|
| 2,909,578 | 10/1959 | Anderson | 585/259 |
| 3,098,882 | 7/1963 | Arnold | 585/259 |
| 3,305,597 | 2/1967 | Straschil et al. | 585/259 |
| 3,309,307 | 3/1967 | Bryant, Jr. | 208/143 |
| 3,310,485 | 3/1967 | Bercik | 208/143 |
| 3,413,214 | 11/1968 | Galbreath | 208/143 |
| 3,451,922 | 6/1969 | Parlas | 208/143 |
| 3,607,969 | 9/1971 | Kronig | 208/143 |
| 3,639,227 | 2/1972 | Jacobson et al. | 208/143 |
| 3,751,515 | 8/1973 | Zadra | 208/143 |
| 3,839,483 | 10/1974 | Carr et al. | 208/143 |
| 3,842,137 | 10/1974 | Libers et al. | 585/259 |
| 4,347,392 | 8/1982 | Cosyns et al. | 585/259 |
| 4,484,015 | 11/1984 | Johnson et al. | 585/259 |
| 4,517,395 | 5/1985 | Obenaus et al. | 208/143 |
| 4,533,779 | 8/1985 | Boitiaux et al. | 585/259 |
| 4,547,600 | 10/1955 | Cosyns et al. | 585/259 |

FOREIGN PATENT DOCUMENTS

| | | | |
|---|---|---|---|
| 3342532 | 5/1984 | Fed. Rep. of Germany | 585/259 |

*Primary Examiner*—Helane E. Myers

*Attorney, Agent, or Firm*—Millen, White & Zelano

[57] ABSTRACT

Disclosed is a process for selective hydrogenation in liquid phase of an effluent originating from an ethane steam cracker in which said effluent is contacted with a catalyst consisting of at least supported palladium characterized in that it is carried out in the presence of a liquid phase containing at least part of the hydrogenated gasoline cut, condensed and recycled, of said effluent.

Said effluent (1), said liquid phase (8) and possibly hydrogen (13) pass through the hydrogenation reactor (4). The product obtained is fractionated (5) into a gaseous cut at the top (7) containing ethylene and a liquid gasoline cut at the bottom which is partially recycled (8).

The process may be used for production of ethylene and for production of gasoline.

16 Claims, 1 Drawing Sheet

Figure 1:
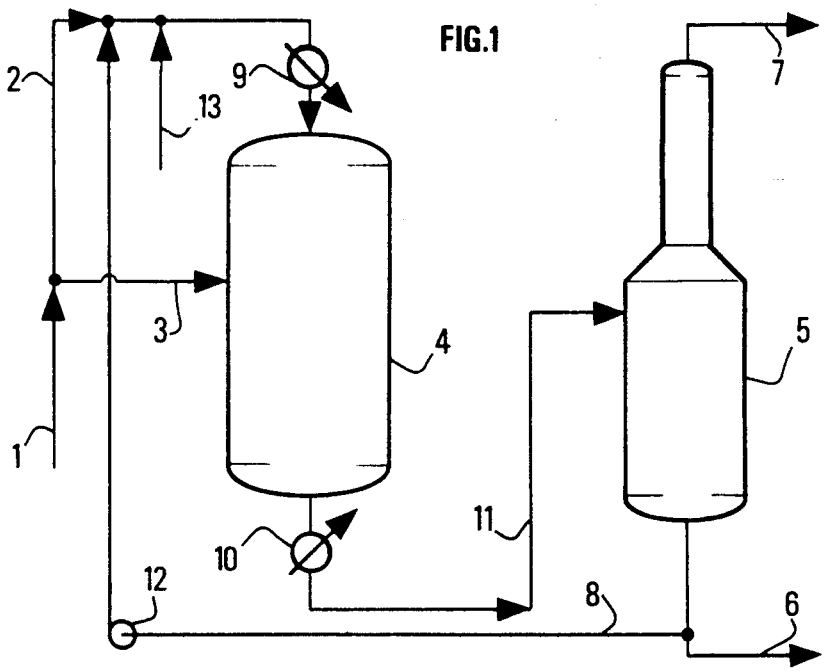

1
2
3
4
5
6
7
8
9
10
11
12
13

T (%poids)
75
50
25
0
100
200
300
400
t (h)

PROCESS FOR SELECTIVE CATALYTIC HYDROGENATION IN LIQUID PHASE OF A NORMALLY GASEOUS FEED CONTAINING ETHYLENE, ACETYLENE AND GASOLINE

This application is a continuation of application Ser. No. 07/327,444, filed Mar. 22, 1989 abandoned.

Thermal conversion methods such as steam cracking, for example, produce olefinic compounds that are of interest in the petrochemical industry but whose upgrading requires selective hydrogenation of acetylenic and diolefinic impurities coproduced by these methods.

These hydrogenations are generally carried out on partial cuts such as, for example, $C_2$ cuts containing ethylene and acetylene, $C_3$ cuts containing propylene, propyne and propadiene, $C_4$ cuts containing butenes and butadiene and gasoline cuts containing aromatics, other olefins and other diolefins.

Separate treatments such as this are only possible if the relative quantities of cuts are similar, which is the case when the steam cracker feed is a naphtha or a gas oil. When the feed consists of ethane, the steam cracker effluent essentially comprises $C_2$ hydrocarbons (hydrocarbons with 2 carbon atoms), the heaviest cuts ($C_4$ and gasoline) being very much in the minority. It is standard practice to roughly separate the condensable liquids and then to send all of the gaseous effluent over a hydrogenation catalyst in order to upgrade the ethylene produced. The weight composition of this effluent of an ethane steam cracker is given in table 1.

TABLE 1

Overall weight composition of an effluent of an ethane steam cracker.

| | |
|---|---|
| Hydrogen | 1.44% |
| Carbon monoxide | 0.06% |
| Methane | 24.79% |
| $C_2$ | 38.65% |
| $C_3$ | 26.70% |
| $C_4$ | 3.41% |
| Gasoline ($C_5$–$C_9$) | 4.95% |

At 15° C., under a pressure of 20 bars (2,000 KPa), an effluent such as this is entirely gaseous: hydrogenation should thus be carried out in the gas phase. But the heaviest parts of this cut ($C_4$ and gasoline) contain highly polymerizable compounds such as butadiene, isoprene and styrene, as indicated in tables 2 and 3, in which typical compositions of $C_4$ and gasoline cuts are given.

TABLE 2

Detailed weight composition of the $C_4$ cut contained in an effluent of an ethane steam cracker.

| | Content in $C_4$ | Content in the totality |
|---|---|---|
| Butadiene | 43% | 1.48% |
| Butenes | 43% | 1.47% |
| Butane | 14% | 0.46% |

The catalysts used in this hydrogenation are rapidly clogged by these polymerization products and the durations of the cycles are thus disadvantageously short.

The object of the present invention is the development of a new process for selective catalytic hydrogenation in liquid phase of a hydrocarbon feed containing a gasoline ($C_{5-9}$-hydrocarbon) normally gaseous (that is, in vapor form under normal conditions of temperature and pressure) hydrocarbon mixture notably containing acetylene and ethylene, the liquid phase (or liquid diluent) in the presence of which this process is carried out, comprising at least part of the condensable fraction of said feed, that is, at least part of the hydrogenated gasoline cut ($C_5$ to $C_9$), is condensed and recycled, to said feed.

TABLE 3

Detailed weight composition of the gasoline cut contained in an effluent of an ethane steam cracker.

| | Content in the gasoline | Content in the totality |
|---|---|---|
| Pentanes + Pentenes | 5.5% | 0.27% |
| Isopropene | 0.4% | 0.02% |
| Hexane + Hexenes | 5.5% | 0.27% |
| Benzene | 51.9% | 2.57% |
| Heptane + Heptenes | 1.6% | 0.08% |
| Toluene | 13.5% | 0.67% |
| Octanes + Octenes | 0.8% | 0.04% |
| Ethylbenzene | 2.6% | 0.13% |
| Xylenes | 2.2% | 0.11% |
| Nonanes + Nonenes | 7.9% | 0.39% |
| Styrene | 8.1% | 0.40% |

In general, the feed (in vapor form) to be hydrogenated can contain:

0 to 6%, preferably 1 to 2.5% in weight of hydrogen;

0 to 40%, preferably 15 to 30% in weight of methane;

25 to 80%, preferably 30 to 45% in weight of $C_2$ hydrocarbons and, in particular, 0.1 to 5%, preferably 0.2 to 2% in weight of acetylene and 15 to 75%, preferably 20 to 35% in weight of ethylene (and for example, 0 to 25% in weight of ethane);

0 to 40%, preferably 15 to 35% in weight of $C_3$ hydrocarbons;

0 to 10%, preferably 1 to 6% in weight of $C_4$ hydrocarbons, and 1 to 20, preferably 1 to 7% in weight of gasoline, that is, hydrocarbons with 5 to 9 carbon atoms ($C_5$+) and, in particular, 0.4 to 11%, preferably 0.8 to 6% in weight of aromatic hydrocarbons (having less than 9 carbon atoms).

This cut to be hydrogenated can also contain a small quantity of carbon monoxide, for example ranging from 0.01 to 1% in weight, preferably from 0.02 to 0.2% in weight.

The feed to be hydrogenated can consist of the effluent of an ethane steam cracker for example.

The presence of hydrogen in the feed to be hydrogenated advantageously allows avoiding working eith an external hydrogen source.

The process according to the invention allows more satisfactory running of the installation, the durations of cycles being greatly increased and, surprisingly, the quality of the liquids recycled in the hydrogenation reactor is improved. The hydrogenated cuts produced in the process comply with the strictest of specifications: in fact, the $C_2$ cut (after hydrogenation and separation) can easily contain less than 5 ppm in weight of acetylene, and the gasoline cut (after hydrogenation and separation) has a Maleic Anhydride Value (MAV), which is a measure of content in conjugated diolefins, determined according to UOP norm No. 356, preferably less than 3.

The hydrogenation catalyst contains of at least supported palladium. The palladium is generally deposited in a proportion from 0.01 to 1% in weight on an appropriate support such as alumina or silica or a mixture of these two compounds.

The palladium may be associated with at least one additional metal chosen, for example, from the group formed by silver and gold, in amounts which generally range from 0.01 to 1% by weight of catalyst. The weight ratio Au/Pd or Ag/Pd or (Au+Ag)/Pd is preferably less than 1.

Hydrogenation can be carried out in at least one reactor in which the catalyst is preferably arranged in fixed beds. FIG. 1 represents a non limiting example of the application of the invention.

The cut to be hydrogenated (1) (for example, the effluent of an ethane steam cracker), the liquid diluent (8) and possibly hydrogen (13) (in the case where the cut to be hydrogenated does not contain any or contains a very small quantity of hydrogen) are introduced into the hydrogenation reactor (4). After cooling down in the exchanger (10), the effluent of said reactor (4) is sent, by the pipe (11), into a distilling tube (5) allowing separation of a gaseous cut at the top (7) (which contains the hydrogen in excess and the hydrocarbons with less than five carbon atoms, for example the methane, the noncondensable gas containing the hydrogen in excess, the hydrogenated $C_2$, $C_3$ and $C_4$ cuts (i.e. hydrogenated $C_4^-$cut)) from a gasoline cut ($C_5$–$C_9$) at the bottom (possibly accompanied by a small quantity of least volatile $C_4$), a gasoline cut which will constitute at least part of the liquid diluent. This liquid diluent is partly recycled, that is, it is sent to the reactor (4) by piping (8) through a pump (12). The other part of this solvent is preferably drawn off (thus purged) before passing through the pump (12) so that the total quantity of gasoline contained in the system (reactor (4)+pipes+distilling tube (5)) is substantially constant, this drawoff constituting the hydrogenated gasoline of the process.

This hydrogenated and drawnoff gasoline cut can be directly used as fuel, i.e. without transformation, because it contains only a very small quantity of diolefins, and thus unwanted gums. The major part of the diolefins are hydrogenated during the method according to the invention.

By using distilling methods known by the person skilled in the art, the $C_2$ cut can moreover be separated easily, as ethylene (which is a mixture of ethylene contained in the original feed and ethylene produced by hydrogenation of acetylene) contained in the gaseous cut discharged at the top of the tube (5): in this way, the process according to the invention also allows production of ethylene.

The whole catalyst is permanently wet with the liquid phase (or liquid diluent) constituting the flux (8) and entering the reactor (4) near its top. The fresh feed to be hydrogenated can be injected towards the top of the reactor (4), by the piping (2) and/or halfway up the catalyst by piping (3). This arrangement allows the quantity of catalyst to be varied during running, thus making it possible to adjust the reactivity of the total mass of catalyst. Possible installation at the liquid inlet point of the reactor (4) of a steam exchanger (9) may allow inlet temperatures of said reactor to be adjusted.

The recycled liquid phase (or liquid diluent) generally contains at least 25%, preferably 50 to 85% and, even more preferably, 60 to 75% in weight of aromatic hydrocarbons (styrene not being counted in the category of aromatic hydrocarbons).

The operating conditions for hydrogenation, according to the invention, are usefully chosen as follows:

total pressure: 10 to 50 bars;

temperature: 10° to 150° C.;

space velocity expressed as volume flow rate of the gaseous cut to be hydrogenated, at normal temperature and pressure (NTP), per volume of catalyst and per hour (gas LHSV): 500 to 20,000, preferably 1000 to 10,000;

volume flow rate of the recycled liquid at normal temperature and pressure (NTP), per volume of catalyst and per hour (liquid LHSV): 1 to 15, preferably between 4 and 12.

Under these conditions of gas LHSV and liquid LHSV, the ratio of the weight flow rate of recycled liquid to the weight flow rate of the gaseous feed to be hydrogenated, at the inlet point of the reactor (4), usually ranges from 0.5 to 20, preferably from 1.0 to 10 and, even more preferably, from 1.5 to 5.

The following examples illustrate the present invention without in any way limiting it.

EXAMPLE 1

In this example which illustrates a prior art technique, a cut, whose weight composition is given in table 4, is treated. A liquid diluent is not used.

TABLE 4

Weight composition of the gaseous cut to be hydrogenated.

| | | | |
|---|---|---|---|
| Hydrogen | 1.44% | Isoprene | 0.02% |
| Carbon monoxide | 0.06% | Hexanes + Hexenes | 0.27% |
| Methane | 24.79% | Benzene | 2.57% |
| Acetylene | 0.37% | | |
| Ethylene | 28.25% | Heptane + Heptenes | 0.08% |
| Ethane | 10.03% | Toluene | 0.67% |
| Propadiene | 0.12% | Octane + Octenes | 0.04% |
| Propyne | 0.28% | Ethylbenzene | 0.13% |
| Propylene | 15.22% | Xylenes | 0.11% |
| Propane | 11.08% | Nonanes + Nonenes | 0.39% |
| Butadiene | 1.48% | Styrene | 0.40% |
| Butenes | 1.47% | | |
| Butane | 0.46% | | |
| Pentane + Pentenes | 0.27% | | |

TABLE 5

Detailed weight composition of the $C_2$ cut contained in the cut to be hydrogenated.

| | Content in $C_2$ | Content in the totality |
|---|---|---|
| Acetylene | 1.0% | 0.37% |
| Ethylene | 73.1% | 28.25% |
| Ethane | 25.9% | 10.03% |

The catalyst contains 500 ppm in weight of palladium deposited on an alumina support of specific surface equal to 9 $m^2/g$ and of porous volume equal to 0.5 $cm^3/g$. The catalyst is arranged in fixed beds in a tubular reactor.

The cut to be hydrogenated is passed through this reactor under the following operating conditions:

Gas LHSV: 2,500 (NTP);

Pressure: 20 bars;

Temperature: 40° C.

The weight composition of the effluent leaving the reactor after 2 days and 15 days of running is given in table 6 for the $C_2$ cut and in table 7 for the gasoline produced ($C_5$–$C_9$).

TABLE 6

| Weight composition of the $C_2$ cut contained in the effluent leaving the reactor. | | |
|---|---|---|
| | after 2 days | after 15 days |
| Acetylene | 4.5 ppm | 0.2% |
| Ethylene | 73.6% | 73.5% |
| Ethane | 26.4% | 26.3% |

TABLE 7

| Weight composition and properties of the gasoline cut contained in the effluent leaving the reactor. | | |
|---|---|---|
| | Composition (in weight) | |
| | After 2 days | After 15 days |
| Paraffins | 22.4% | 22.2% |
| Diolefins + Styrene | 0.3% | 6.0% |
| Olefins | 10.3% | 4.8% |
| Aromatics | 67.0% | 67.0% |
| MAV | 3 | 60 |
| Octane number | 98 | not measured* |

*as conjugated diolefins, and thus gums, are present in non-negligible quantities.

It can be thus observed that, under these conditions, the catalyst is rapidly deactivated due to clogging and that the hydrogenation reaction is insufficient: in fact, on the one hand, only 80% of acetylene is converted at the end of 15 days of running (acetylene content of the $C_2$ cut: 1.0% in weight on entry, 0.2% in weight on exit) and, on the other hand, conversion of diolefins (and styrene) is substantially reduced after 15 days of running (diolefins (and styrene) content of the gasoline cut: 0.3% in weight after 2 days of running, 6.0% in weight after 15 days of running).

The only possible way to increase conversion would be to increase the operating temperature, which would inevitably act disadvanteously in olefins yield and further increase the clogging of the catalyst.

EXAMPLE 2
(ACCORDING TO THE INVENTION)

The same feed as in example 1 is treated, the catalyst used also being the same.

This catalyst is arranged in fixed beds in a tubular reactor; the unit also comprises a distilling tube containing 10 trays. This tube functions in such a way that the gasoline cut ($C_5$–$C_9$) and thus all the input benzene is found in the bottom draw off and at least the major part of $C_4^-$ (hydrocarbons having four carbon atoms at the most) is found at the top. The liquid at the bottom is taken up by a pump and constitutes the liquid inlet of the reactor, the cut to be hydrogenated being mixed with this liquid at the inlet of the reactor.

When the unit is started up, the loop is filled with toluene and a small-scale continuous purge on the liquid drawn off from the bottom of the tube is carried out during the operation in order to obtain a constant liquid level in the tube.

Operating conditions are as follows:

Gas LHSV: 2,500 (NTP);

Pressure: 20 bars;

Temperature: 40° C.;

Liquid LHSV: 10 (NTP).

Figure 2:
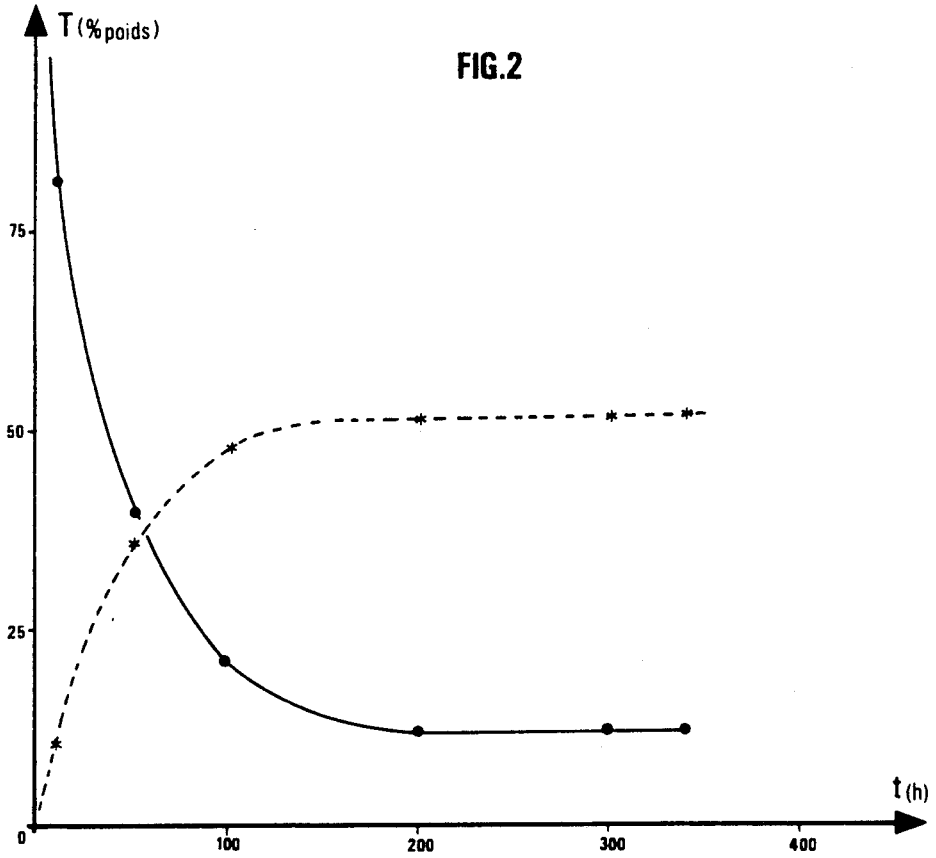

Under these conditions of gas and liquid LHSV, the weight flow rate of the recycled liquid is equal to about 2.8 times the weight flow rate of the gaseous feed to be hydrogenated. Sampling for analysis of the purged liquid was carried out and gives the results presented in FIG. 2 (toluene content (% weight) (continuous curve) and benzene content (discontinuous curve) of the draw off liquid as a function of time (hours)). It is observed that at the end of 200 hours, the liquid phase has a constant composition which corresponds to the condensable part of the cut to be hydrogenated. The weight composition of the gaseous and liquid effluents, at the top and bottom of the tube respectively, after 10 days and 2 months of running are given in tables 8 and 9 respectively.

TABLE 8

| Weight composition of the $C_2$ cut. | | |
|---|---|---|
| | after 10 days | after 2 months |
| Acetylene | 3.2 ppm | 4 ppm |
| Ethylene | 73.9% | 73.7% |
| Ethane | 26.1% | 26.3% |

TABLE 9

| Weight composition and properties of the gasoline cut. | | |
|---|---|---|
| | Composition (in weight) | |
| | After 10 days | After 2 months |
| Paraffins | 22.33% | 22.21% |
| Diolefins + Styrene | 0.27% | 0.29% |
| Olefins | 10% | 10.1% |
| Aromatics | 67.4% | 67.4% |
| MAV | 2.5 | 2.7 |
| Octane number | 98 | 98 |

It is observed that contrary to example 1, the hydrogenation performance is stable. In fact, at the end of 2 months, the results are similar to the initial results (see table 10).

TABLE 10

| Weight conversions and yields. | | |
|---|---|---|
| | After 10 days | After 2 months |
| Conversions: | | |
| Acetylene | 99.97% | 99.96% |
| Propyne + Propadiene | 94.2% | 93.2% |
| Butadiene | 93.8% | 93.1% |
| Isoprene + Styerene | 96.6% | 95.4% |
| Yields: | | |
| Ethylene | 101% | 100.8% |
| Propylene | 101.9% | 101.7% |
| Butenes | 193% | 190% |

We claim:

1. A process for the selective hydrogenation in the liquid phase of a hydrocarbon feed containing at least a gasoline cut and a normally gaseous hydrocarbon mixture containing ethylene and acetylene, said process comprising contacting said feed with a catalyst comprising at least supported palladium, whereby hydrogenation occurs, wherein the process is carried out in the presence of a liquid phase, said liquid phase containing at least part of a hydrogenated gasoline cut, which has been condensed and recycled after said hydrogenation to said feed, and wherein the feed contains 25 to 80% by weight of $C_2$ hydrocarbons.

2. A process according to claim 1, wherein said hydrocarbon feed contains 0 to 6% by weight of hydrogen, 0 to 40% by weight of methane, 25 to 80% by weight of $C_2$ hydrocarbons, 0 to 40% by weight of $C_3$ hydrocarbons, 0 to 50% by weight of $C_4$ hydrocarbons and 1 to 20% by weight of gasoline.

3. A process according to claim 1, wherein said hydrocarbon feed contains 1 to 2.5% by weight of hydrogen, 15 to 30% by weight of methane, 30 to 45% by weight of $C_2$ hydrocarbons, 15 to 35% by weight of $C_3$ hydrocarbons, 1 to 6% by weight of $C_4$ hydrocarbons and 1 to 7% by weight of gasoline.

4. A process according to claim 1 wherein said hydrocarbon feed is an effluent originating from an ethane steam cracker.

5. A process according to claim 1, wherein said liquid phase contains at least 25% by weight of aromatic hydrocarbons.

6. A process according to claim 5, wherein said liquid phase contains 50 to 85% by weight of aromatic hydrocarbons.

7. A process according to claim 1, wherein said catalyst comprises palladium and at least one additional metal chosen from the group consisting of gold and silver, the mixture of palladium and at least one additional metal being deposited on at least one support chosen from the group consisting of alumina and silica.

8. A process according to claim 1, wherein the ratio of weight flow rate of said liquid phase to the weight flow rate of said feed to be hydrogenated ranges from 0.5 to 20.

9. A process according to claim 8, wherein said ratio ranges from 1 to 10.

10. A process for the production of ethylene and gasoline, comprising hydrogenating in the liquid phase a hydrocarbon feed containing at least a gasoline cut and a normally gaseous hydrocarbon mixture containing ethylene and acetylene, comprising contacting said feed with a catalyst comprising at least supported palladium, wherein the process is carried out in the presence of a liquid phase, said liquid phase containing at least part of a hydrogenated gasoline cut, which has been condensed and recycled to said feed, and wherein the feed contains 25 to 80% by weight of $C_2$ hydrocarbons whereby ethylene and gasoline are produced.

11. A process according to claim 2, wherein the $C_2$ hydrocarbons in the hydrocarbon feed comprise 0.1 to 5% by weight of acetylene and 15 to 75% by weight of ethylene, based on the total feed.

12. A process according to claim 3, wherein the $C_2$ hydrocarbons in the hydrocarbon feed comprise 0.2 to 2% by weight of acetylene and 20 to 35% by weight of ethylene, based on the total feed.

13. A process according to claim 7, wherein the catalyst comprises 0.01 to 1% by weight of silver or gold, based on catalyst weight.

14. A process according to claim 7, wherein the weight ratio of Au/Pd, Ag/Pd or (Au+Ag)/Pd is less than 1.

15. A process according to claim 1, wherein the hydrogenated gasoline cut consists essentially of $C_{5-9}$-hydrocarbons.

16. A process according to claim 10, wherein the hydrogenated gasoline cut consists essentially of $C_{5-9}$-hydrocarbons.

* * * * *